United States Patent [19]

Ludemann et al.

[11] 4,131,041

[45] Dec. 26, 1978

[54] COLLECTOR FORMING AN ACCUMULATING STACK FROM SUCCESSIVELY RECEIVED SEVERED SECTIONS OF PHOTOGRAPHIC STRIP

[75] Inventors: Heinz Lüdemann, Münich; Harald Fengler, Taufkirchen; Ferdinand Schaner, Münich, all of Fed. Rep. of Germany

[73] Assignee: AGFA-Gevaert AG, Leverkusen, Fed. Rep. of Germany

[21] Appl. No.: 830,446

[22] Filed: Sep. 6, 1977

[30] Foreign Application Priority Data

Sep. 8, 1976 [DE] Fed. Rep. of Germany ..... 2640478

[51] Int. Cl.[2] ..... B65H 31/24

[52] U.S. Cl. ..... 83/94; 83/90; 271/9; 271/64

[58] Field of Search ..... 83/94, 90; 27/64, 217, 27/214, 220, 173, 9

[56] References Cited

U.S. PATENT DOCUMENTS

| | | | |
|---|---|---|---|
| 3,762,252 | 10/1973 | Hujer et al. | 83/94 |
| 4,049,255 | 9/1977 | Stange et al. | 271/9 |

*Primary Examiner*—Donald R. Schran
*Attorney, Agent, or Firm*—Michael J. Striker

[57] ABSTRACT

A long photographic strip is transported along a predetermined path and comprises a succession of customer orders joined end-to-end. At a cutting station along the path, successive leading ends of the transported strip are severed from the remainder, to successively form severed strip sections. A collector receives the successively formed severed strip sections in succession and forms an accumulating stack of such sections. The successively received strip sections are held in position in the accumulating stack at the collector individually. Upon accumulation of all the strip sections constituting a customer order, the holding action exerted upon the individually held strip sections is relieved, and the strip sections are removed from the collector as a single stack, either manually or by mechanical means.

17 Claims, 6 Drawing Figures

COLLECTOR FORMING AN ACCUMULATING STACK FROM SUCCESSIVELY RECEIVED SEVERED SECTIONS OF PHOTOGRAPHIC STRIP

BACKGROUND OF THE INVENTION

The invention relates to collectors which receive successively formed severed sections of photographic strip in succession and form an accumulating stack of such sections.

In automated film-processing installations, the photographic strips constituting individual customer orders are typically joined end-to-end, to form a long photographic strip which is automatically processed. After printing, the long photographic strip is severed into short sections, usually containing four to six negatives each. Notch detectors or the like at the cutting station detect cutting marks and end-of-order marks, to assure that the cuts are made between film frames and that individual customer orders are properly separated one from the next. At the end of a customer order, the operation of the cutting station is usually interrupted, to allow the strip sections of the customer order to be inserted into an envelope, or otherwise packaged.

In systems of this type, the successively formed severed sections of photographic strip are conventionally collected by a collector as an accumulating stack of severed strip sections, and then removed by hand and inserted into an envelope.

Commonly owned U.S. Pat. No. 3,762,252 discloses an automatic strip section collector, in which the severed strip sections are conveyed by belts into the collecting gap of a collector unit. To prevent the infed strip sections from being moved through and out of the collecting gap, the gap is provided with an end stop, to retain the infed strip sections in proper position. However, with this collecting system, the leading end of an arriving strip section may push against one of the already collected strip sections and cause one of the already collected strip sections to bend or kink, especially when the strip sections have a high tendency to curl and are not flat in their unstressed condition. However, the development of even one such kink can prevent further infeed of severed strip sections.

In general, the severed strip sections may exhibit the aforementioned tendency to curl and/or transverse and/or longitudinal cross-sectional curvature. These characteristics may be present in different combinations in different strip sections and be present to varying degrees, even within one customer order. As a result, when the successively formed severed strip sections are simply collected in a collecting slot or collecting compartment, the positions they assume will exhibit considerable variation.

SUMMARY OF THE INVENTION

It is the general object of the invention to provide a novel collecting system for successively severed photographic strip sections, of such a design as to assure that the strip sections successively received by the collecting system form a very orderly accumulating stack.

This object can be achieved, according to one advantageous concept of the invention, by holding the successively received strip sections in position in the accumulating stack, individually.

The inventive expedient establishes and maintains the position of each strip section in the accumulating stack on an individual basis. Later arriving strip sections received by the strip section collector can have no effect upon the positions of the earlier arrived strip sections of the accumulating stack. The degree of independence of the position of each strip section from the positions of all other strip sections in the accumulating stack is very high. Variations in the tendency to curl and/or transverse and/or longitudinal cross-sectional curvature have no problematic effect. When all the strip sections of a customer order have been collected, the stack of strip sections constituting the customer order will be neat and orderly and can be inserted into a customer envelope directly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
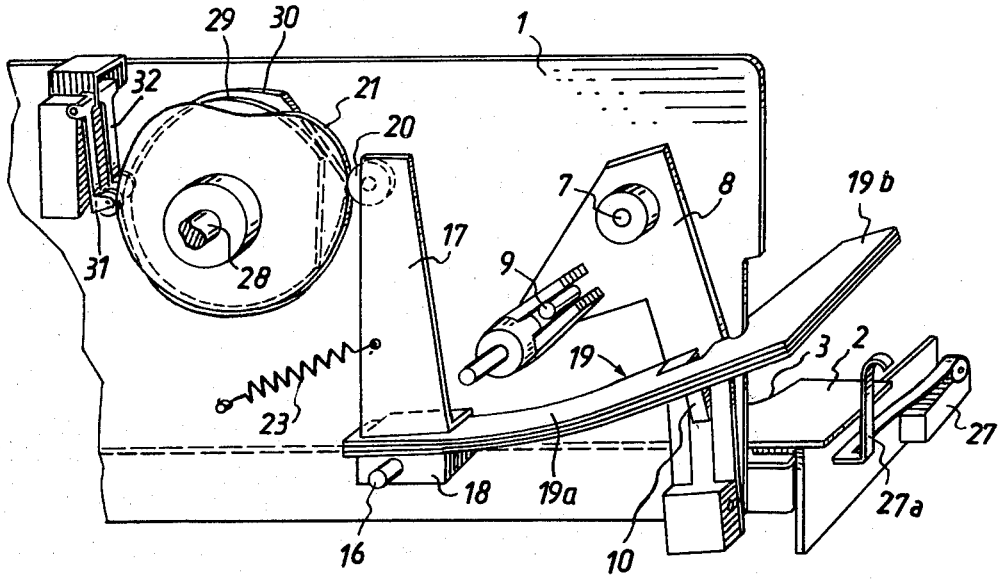
FIG. 1 is a perspective view of an exemplary embodiment of the invention.

As shown in FIG. 1, a vertical mounting plate 1 is provided on a horizontal work table 2. Severed sections of a photographic strip are successively deposited on work table 2. Work table 2 is provided with a large cut-out 3, to facilitate manual removal of a collected stack of photographic strips.

Figure 2:
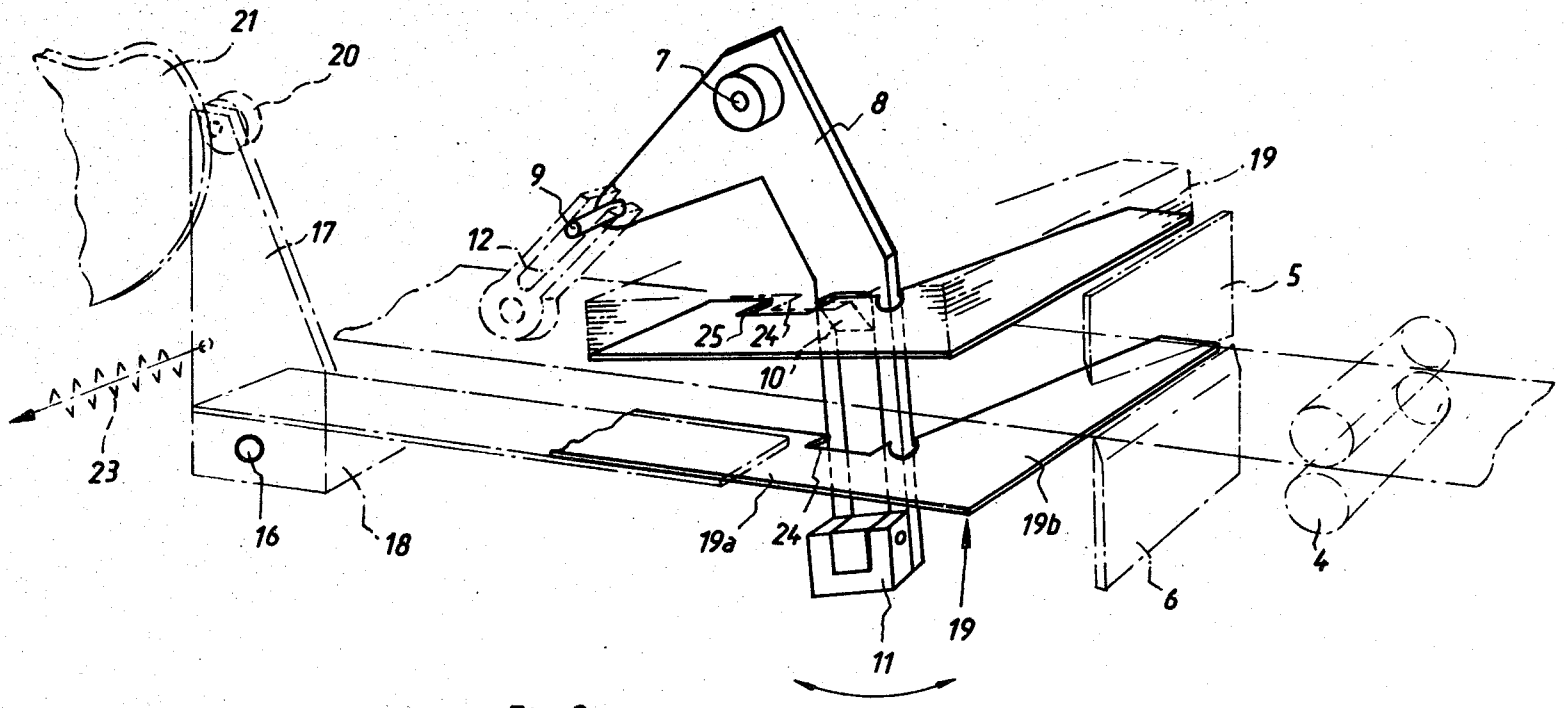
FIG. 2 is a perspective view of the structure shown in FIG. 1, seen at a somewhat different angle on a somewhat larger scale and in conjunction with the cutting station of the strip-processing apparatus.

As shown in FIG. 2, the apparatus of FIG. 1 is located downstream of a cutting station, of which only a pair of transport rollers 4, the upper cutting blade 5 and the lower cutting blade 6 are depicted.

Vertical mounting plate 1 carries a mounting pin 7, on which a two-armed lever 8 is swingably mounted. The left arm of lever 8 is provided with a pin 9 which extends generally parallel to the pivot axis of lever 8. The right arm of lever 8 is provided with a retractably mounted wedge structure 10. Wedge structure 10 is at its lower end swingably mounted on a bearing carried in a mounting block located at the lowermost end of the right arm of lever 8. A (non-illustrated)biasing spring urges the wedge structure 10 toward its non-retracted position.

Figure 3:
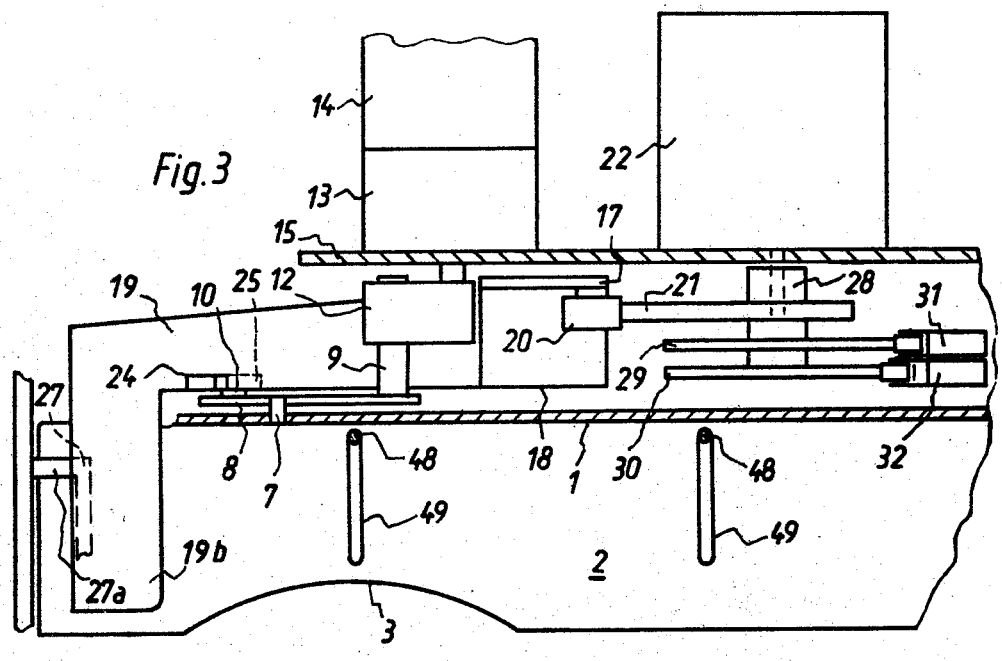
FIG. 3 is a top view of the structure.

The aforementioned pin 9 on the left arm of swingable lever 8 is received within a bifurcated slot coupling 12 (see FIG. 2). Bifurcated slot coupling 12 is mounted on the common rotor shaft of two rotary electromagnets 13, 14 (see FIG. 3). The rotary electromagnets 13, 14 are mounted on a further vertical mounting wall 15 arranged parallel to mounting plate 1 (see FIG. 3).

Vertical mounting plate 1 furthermore carries a mounting pin 16 (see FIG. 1) located at a level slightly below that of work table 2. Swingably mounted on pin 16 is an upwardly extending lever 17. In particular, the lower end of lever 17 is provided with an angled-off flange supported on a mounting block 18, and it is mounting block 18 per se which is turnably mounted on pin 16. The angled-off flange at the bottom of lever 17 and the mounting block 18 clamp between them the left ends (as viewed in FIG. 1) of a stack of L-shaped spring plates 19.

Rotatably mounted at the upper end of lever 17 is a cam-follower roller 20 which bears upon a rotary cam 21. Rotary cam 21 is mounted on the output shaft 28 of a motor 22 (see FIG. 3). Motor 22 is mounted on vertical mounting plate 15. A tension spring 23 connected at one end to lever 17 and at its other end to mounting plate 1 urges swingable lever 17 counterclockwise.

The stack of spring plates 19 is comprised of flat, L-shaped elastic elements, e.g., resilient plates of metal or plastic. When the stack of spring plates 19 assumes an unstressed condition (explained below), the plates 19 lie upon the work table 2. In particular, it is the shorter legs 19*b* of the spring plates 19 which will lie flat upon the work table 2, whereas the longer legs 19*a* of the plates extend parallel to mounting wall 1, from the shorter legs 19*b* to the location where they are clamped between mounting block 18 and the angled-off bottom flange of swingable lever 17. The shorter legs 19*a* extend generally parallel to the cutting blades 5 and 6 of the cutting station.

The leg 19*a* of each L-shaped spring plate 19 is provided with a cut-out 24 or 25 (see especially FIG. 2) located in the operative vicinity of retractable wedge structure 10. The dimensions of each cut-out 24 and 25 are somewhat larger than the corresponding dimensions of the wedge structure 10. The first (bottommost) and all other odd-numbered spring plates 19 are each provided with a cut-out 24. The second (next from bottommost) and all other even-numbered spring plates are each provided with a cut-out 25. All cut-outs 24 are identically located on their respective spring plates 19. All cut-outs 25 are identically located on their respective spring plates 19. However, the cut-outs 25 are offset relative to the cut-outs 24, in the direction of elongation of the legs 19*a* of the spring plates.

The illustrated system operates as follows:

When rotary cam 21 rotates, the cam-follower roller 20 enters into the smallest-radius sector of the cam, so that lever 17 is swung by spring 23 counterclockwise. Because the ends of legs 19*a* of spring plates 19 are clamped between mounting block 18 and the angled-off bottom flange of lever 17, the stack of spring plates 19 swings up counterclockwise (as viewed in FIG. 1). As the stack of plates 19 swings up, it displaces wedge structure 10 inward into the retracted position of the wedge structure. When the stack of plates 19 has risen to a height above the wedge structure 10, the wedge structure 10 snaps back to its non-retracted position.

Immediately after this has occurred, the continued rotation of cam 21 begins to displace the swingable lever 17 clockwise (as viewed in FIG. 1), and the lever 17 is returned to its original position, wherein the clamped sections of the spring plates 19 are again oriented generally horizontal. However, the wedge structure 10, because it is in its non-retracted position, acts as a latch and supports the free end of the stack of plates 19 from below, so that this end of the stack of plates 19 cannot return to its original horizontal position. Accordingly, the stack of spring plates 19 is now in its stressed condition, and is in readiness for the receipt of a succession of severed photographic strips.

Photographic strip 26 begins to be transported through the cutting station 4, 5, 6. The cutting means 5, 6 are activated by a succession of cutting command signals, to sever the successive leading sections of the photographic strip. Successive cutting command signals are utilized to alternately energize the rotary magnets 13 and 14; i.e., one cutting command signal triggers energization of rotary magnet 13, the next triggers energization of rotary magnet 14, the third triggers energization of rotary magnet 13, and so forth. Energization of one of the rotary magnets 13 or 14 in response to a cutting command signal is effected after the elapse of a time delay on the order of magnitude of 25 milliseconds.

When rotary magnet 13 is energized, bifurcated slot coupling 12 turns clockwise (as viewed in FIGS. 1 and 2). When rotary magnet 14 is energized, bifurcated slot coupling 12 turns counterclockwise. The alternate energization of the rotary magnets 13, 14 accordingly causes the lever 8 to swing back and forth on its mounting rod 7, and the wedge structure 10 on lever 8 performs a generally linear reciprocatory movement.

When transport of the long photographic strip 26 through the cutting station commences, the leading end of the strip is allowed to enter the space beneath the legs 19*b* of the raised stack of spring plates, whereupon a cutting command signal is generated, and the leading section of the strip is severed. After the elapse of the 25-millisecond time delay, the first cutting command signal causes one of the rotary magnets 13, 14 to become energized. The wedge structure 10 performs a stroke, and when the wedge structure moves into register with the cut-out 24 in the bottommost plate 19, the bottommost plate 19 drops, clamping the first severed strip section 26′ against the work table 2. The second from bottommost plate 19 cannot at this point drop down, because its cut-out 25 is not in register with wedge structure 10. Moreover, as wedge structure 10 completes its first stroke, it will not come into register with this cut-out 25. The position of register with cut-out 25 is passed by wedge structure 10 before the wedge structure 10 reaches the position of register with the cut-out 24 of the bottommost plate 19.

As photographic strip 26 continues to be transported through the severing station 4, 5, 6, the new leading end of the strip 26 enters into the space above the first (already dropped) spring plate 19 and below the remaining (still raised) spring plates 19 of the stack. The second cutting command signal is generated, and the new leading end of the strip 26 is severed. After the elapse of the 25-millisecond time delay, the second cutting command signal triggers energization of the other one of the rotary electromagnets 13, 14. As a consequence, wedge structure 10 now performs a return stroke, comes into register with the cut-out 25 of the second plate 19, and the second plate 19 drops, clamping the second severed section 26′ of strip between itself and the already dropped first plate 19.

Accordingly, the spring plates 19 drop, one by one, in synchronism with successive cutting operations. The 25-millisecond time delay is utilized when it is desired that a spring plate 19 not drop down onto the current leading end of the strip until after this section of the strip has been severed from the remainder.

When a spring plate 19 drops down upon a severed section 26′ of photographic strip, it thereafter presses down upon the section of strip beneath it with a force sufficient to assure that the strip will be securely held and cannot be displaced. This holding force can be provided by establishing the normal position of the clamped ends of the spring plates 19 somewhat clockwise relative to an exactly horizontal position.

When the last section of photographic strip 26 in a customer order has entered the collecting station, an end-of-order mark (or the like) is detected and the last in the series of cutting command signals is produced. This last section of strip is severed, and a spring plate 19 drops upon it. Additionally, the end-of-order signal is used to energize motor 22, turn cam 21 and cause lever 17 to swing counterclockwise to a limited extent. In particular, lever 17 is swung counterclockwise to a limited extent such that the downward pressing force exerted by the stack of dropped spring plates 19 is relieved, so that the spring plates 19 no longer press down upon the photographic strip sections 26' with which they are interleaved. At this point, the strip sections 26' are held only loosely between the dropped spring plates 19 and can be easily removed as a single stack of photographic strips, either by hand (facilitated by provision of cut-out 3), or else by automatic means.

Figure 4:
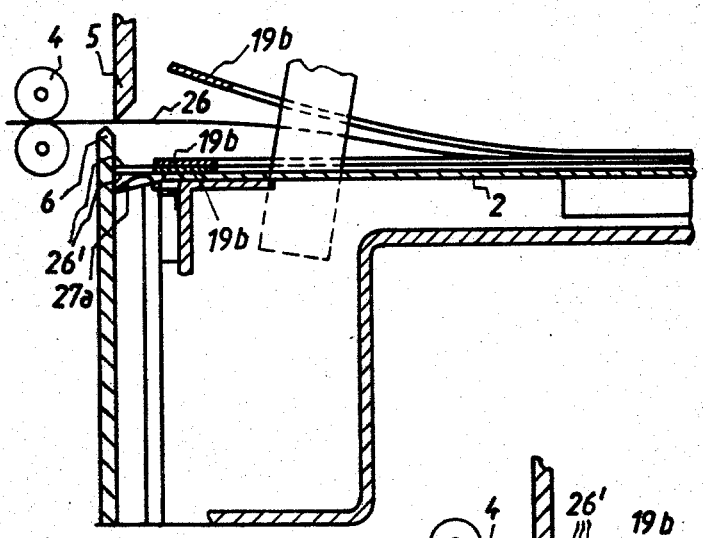
FIG. 4 is a side view of the structure shown in FIG. 1, during one phase of operations.
Figure 5:
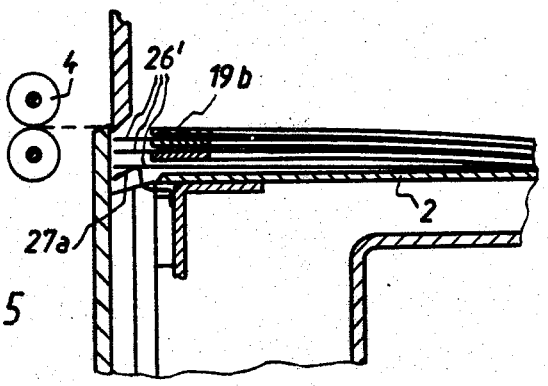
FIG. 5 is a view similar to FIG. 4, but during another phase of operation.

FIGS. 4 and 5 are similar sectional views through a stack of photographic strip sections 26' and interleaved spring plates 19; FIG. 4 depicts the situation where the strip sections 26' are firmly held, and FIG. 5 the situation where strip sections 26' are loosely held. The cutting station is located to the left of the stack of spring plates 19, in FIGS. 4 and 5.

In FIG. 4, the first severed strip section 26' is shown firmly held beneath the first (bottommost) dropped plate 19. The second severed strip section 26' is shown firmly held beneath the second dropped plate 19. The leading end section of the photographic strip 26 (destined to form, after being severed, the last strip section of a customer order) is being fed by the transport rollers 4 into the space beneath the third (still undropped) spring plate 19. When this leading end section of strip 26 has been infed to a sufficient extent, a cutting command signal is generated, as already described. The transport rollers 4 discontinue further infeed of the leading end section, and the cutting blade 5 drops, severing the leading end section from the remainder of the strip 26. Thereupon, the third spring plate 19 drops onto this last strip section. All three strip sections are firmly held. Then, in response to the end-of-order signal, and as already described, the dropped spring plates 19 are relieved, as shown in FIG. 5, so that the plates 19 hold the strip sections 26' only loosely, so that they can be pulled out in the form of a single stack of three strip sections.

The control of the operations just described can be implemented using three microswitches 27, 31, 32. The first microswitch 27 (see especially FIG. 1) is located between the cutting station and the collecting station, and is provided with a sensing element **27*a*. Sensing element 27*a* projects into the space intermediate cutting blade 5 and the upstream end of the stack of spring plates 19, normally above the level of work table 2. When the first strip section 26' in a customer order has been fed into the collecting station, and the first (bottommost) plate 19 has dropped upon it, the first strip section 26' downwardly displaces sensing element 27*a*, activating microswitch 27. In addition to rotary cam 21, there are also mounted on output shaft 28 of motor 22 two further cams 29 and 30, which cooperate with second and third microswitches 31 and 32 (see FIG. 2, and especially FIG. 1). As explained above, prior to the start of a collecting operation, lever 17 is first swung counterclockwise, to raise all spring plates 19 to above the wedge structure 10. Thereafter, the lever 17 is swung clockwise, to stress the raised spring plates 19, so that when they drop down one-by-one they will exert holding force. After the stack of plates 19 has been raised and then stressed, a "spring-plates stressed" signal is generated, and this signal persists as the spring plates drop one-by-one, even after all plates have been dropped, until the spring plates are slightly raised and thereby relieved, to permit the collected strip sections to be removed. As soon as the spring plates are relieved, a persisting "spring-plates relieved" signal is generated. These two signals are generated by microswitches 31 and 32**.

Figure 6:
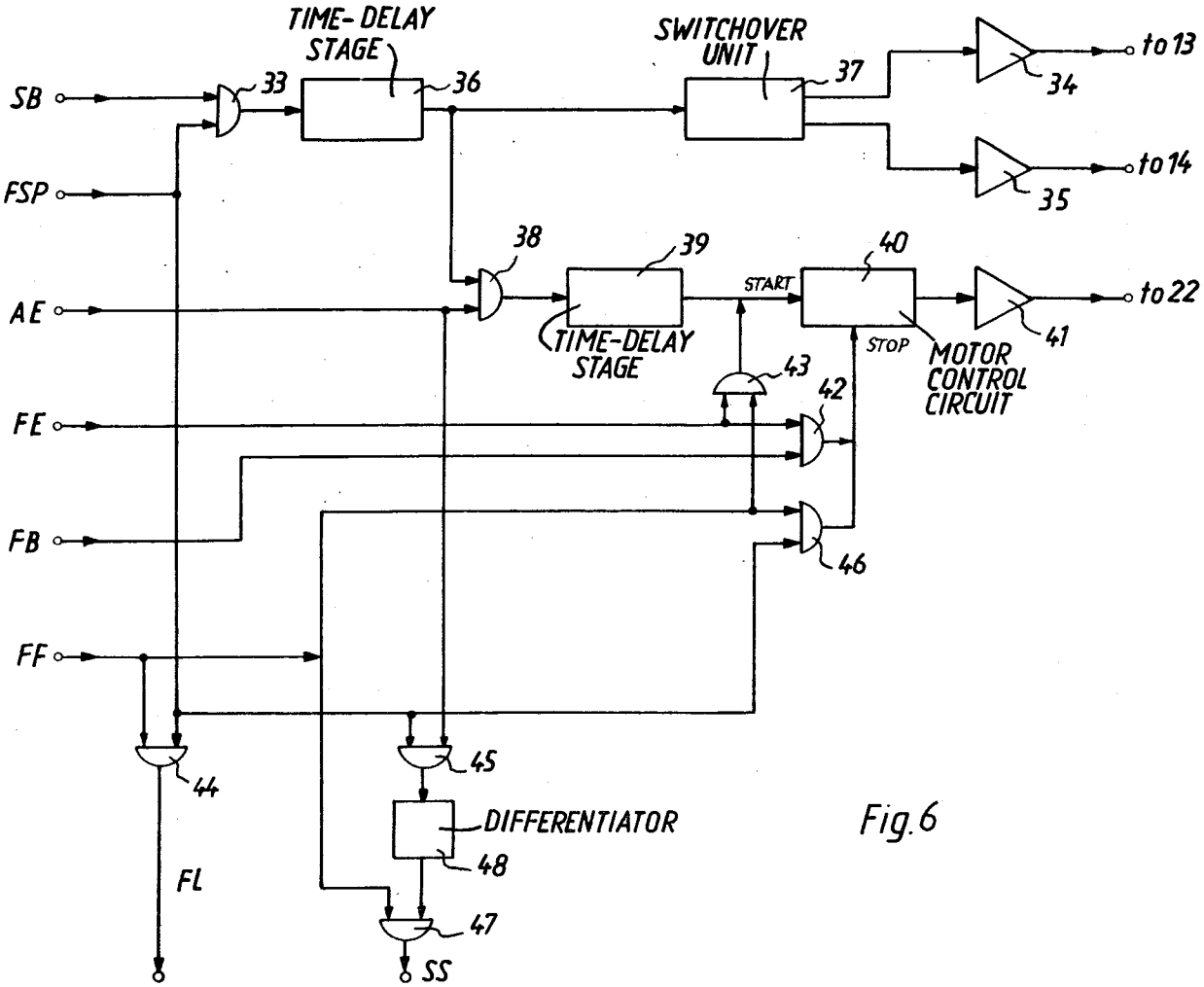
FIG. 6 is an exemplary control circuit used to implement the sequence of operations to be performed.

FIG. 6 depicts a circuit for implementing the sequence of operations described above.

A cutting command signal SB is applied to one input of an AND-gate 33, for example in response to detection of a cutting mark on the lateral edge of the transported strip. The aforementioned "spring-plates stressed" signal FSP is applied to the other input of gate 33, to enable gate 33 for transmission of cutting command signals SB. Accordingly, each cutting command signal SB is transmitted to a switchover unit 37, via a time-delay stage 36. Switchover unit 37 produces an output signal on alternate ones of its two outputs, in response to receipt of successive cutting command signals from gate 33. For example, switchover unit 37 can include a flip-flop which undergoes a change of state in response to each cutting command signal received from AND-gate 33. The signal produces on alternate ones of the outputs of unit 37 is applied to alternate ones of two power amplifiers 34, 35 for the rotary magnets 13, 14. Rotary magnets 13, 14 are thereby energized alternately, the lever 8 and wedge structure 10 swing forth and back, and the spring plates 19 drop down, one by one.

At the end of a customer order, both a cutting command signal SB and an end-of-order signal AE are produced, for example in response to cutting command and end-of-order markings on the edge of the transported strip. The signal SB is generated first, and the signal AE somewhat thereafter. This last cutting command signal SB causes the last cutting operation for the customer order to be performed. These two signals SB and AE are applied to the inputs of an AND-gate 38, which transmits a control signal, through the intermediary of a time-delay stage 39, to the start input of a motor-control circuit 40 for motor 22. Motor 22 is energized, via power amplifier 41, and lever 17 is turned clockwise, to relieve the stack of dropped spring plates 19, in preparation for removal of the collected strip sections 26'. Time-delay stage 39 introduces a time delay of about 50 milliseconds, to assure that motor 22 does not begin to relieve the dropped spring plates until after a spring plate 19 has actually dropped down upon the last strip section 26' of the customer order.

When, in fact, the dropped spring plates have been relieved, microswitch 31 senses this indirectly, via cam 29, and transmits a "spring-plates relieved" signal FE to one input of an AND-gate 42. AND-gate 42 transmits this signal only when enabled. Gate 42 is enabled by a "film-plane occupied" signal FB, furnished by microswitch 27. I.e., microswitch 27 furnishes this signal FB only if a collected strip section 26' is present in the collecting station beneath a dropped spring plate 19 and is depressing the sensing element 27*a*. Accordingly, the "spring-plates relieved" signal FE is transmitted by the enabled gate 42 to the stop input of the motor-control circuit 40 for motor 22, and motor 22 stops. The system now waits until the collected stack of severed strip sections 26′ is removed from the stack of dropped spring plates 19, either manually or automatically by mechanical means.

When now, the collected stack of strip sections is removed, microswitch 27 furnishes a "film-plane unoccupied" signal FF to one input of an AND-gate 43, the other input of which receives the "spring-plates relieved" signal FE. The AND-gate 43 applies a signal to the start input of motor-control circuit 40. Motor 22 resumes operation, and cam 21 turns, causing all dropped spring plates to be lifted to the cocked position and to thereafter become stressed, in preparation for the next collecting operation. This state of readiness is detected by microswitch 32, which transmits a "spring-plates stressed" signal FSP to AND-gates 33, 44, 45, 46. Because AND-gate 46 is in receipt of a "film-plane unoccupied" signal FF, another stop signal is applied to the motor-control circuit 40, interrupting rotation of cam 21. Via AND-gate 44, an enablement signal F1 is transmitted to the cutting station, indicating that no strips are present at the collecting station. The end-of-order signal AE is furthermore applied to an AND-gate 45, and via a differentiator stage 48 a signal is applied to an AND-gate 47, which transmits a start signal SS to the cutting station, provided that the other input of AND-gate 47 is in receipt of a "film-plane unoccupied" signal FF.

It will be appreciated that the exemplary embodiment disclosed herein can be modified in a great variety of ways. For example, the spring plates 19 need not be L-shaped. Advantageously, the holding force applied by the spring plates should be applied as near to the cutting station as possible, so that even very short severed strip sections can be reliably held.

It will be appreciated that the rotary cam arrangement, rotary magnets, bifurcated slot coupling, the lever mounting of the spring plates, etc., are purely exemplary. For example, the wedge structure 10 could be caused to perform its back and forth strokes by a purely linear reciprocator, with comparable frequency and reliability. The use of cams 29 and 30 and the cooperating microswitches 31 and 32, to detect the reaching of certain points in the sequence of operations and initiate certain operations, is purely exemplary; other control means, deriving the requisite information from other locations within the system, could be employed. For example, detector switches equivalent in function to switches 31, 32 could sense the position of lever 17 directly.

Likewise, the illustrated wedge structure 10 is merely exemplary, and other equivalent means could be employed. The function performed by the wedge structure could be performed by a correspondingly located retractable roller, which would be in rolling engagement with the spring plates and therefore less subject to frictional wear. Additionally, other means could be provided to cause the spring plates to drop, one by one.

The illustrated embodiment is particularly well suited for manual removal of a collected stack of severed strip sections. However, automatic removal of the collected stack could also be utilized. For example, in FIG. 3, the work table 2 is provided with transverse slots 49 through which lateral shifting elements 48 project. At the end of the collecting operation, when the spring plates are relieved, the elements 48 could laterally displace the collected stack of strip sections into a (non-illustrated) envelope held open to receive them at a laterally located insertion station.

It will be understood that each of the elements described above, or two or more together, may also find a useful application in other types of constructions and circuits differing from the types described above.

While the invention has been illustrated and described as embodied in an apparatus for collecting severed sections of photograph strip together constituting a customer order, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for processing a long photographic strip, in combination, means for transporting the long photographic strip along a predetermined path; cutting means located along the path and operative for severing the successive leading end sections of the strip from the remainder of the strip to successively form severed strip sections; and collecting means operative for receiving the successively formed severed strip sections in succession and forming an accumulating stack of such sections, including holding means operative for holding the successively received strip sections in position in the accumulating stack individually, the holding means comprising a succession of individually activatable holding units, and means for activating successive ones of the succession of holding units in synchronism with the receipt of successive severed strip sections by the collecting means, the succession of individually activatable holding units comprising a stack of holding plates, the means for activating the successive ones of the holding units comprising means for laying successive ones of the holding plates upon respective successively received ones of the strip sections received by the collecting means and causing each holding plate laid upon a received strip section to exert a holding force upon the respective strip section.

2. In an apparatus as defined in claim 1, the collecting means including means operative when activated for reducing the holding force exerted by the holding plates upon the accumulated stack of strip sections to facilitate removal of the accumulated strip sections from the collecting means as a stack.

3. In an apparatus as defined in claim 1, the collecting means including means operative when activated for reducing the holding force exerted by all holding plates upon the accumulated stack of strip sections simultaneously to facilitate removal of the accumulated strip sections from the collecting means as a stack.

4. In an apparatus as defined in claim 1, the holding plates being resilient spring plates having first ends serving to apply holding force to the received strip sections and having second ends, the means for laying the plates and causing them to exert holding force comprising means mounting the stack of spring plates at the second ends thereof for turning movement, releasable locking means operative when the stack is turned in a first direction to a first angular position for preventing return movement of the stack in an opposite second direction, but operative each time released for permitting one spring plate to move in the second direction, means operative for stressing the stack of spring plates by turning the stack in the first direction to the first angular position and then turning the stack of spring plates at the second ends thereof in the second direction to a second angular position such that upon release of spring plates by the locking means the stressed spring plates move to the received strip sections and press against the latter, and means operative for repeatedly releasing the locking means in synchronism with the arrival of successive strip sections at the collecting means.

5. In an apparatus as defined in claim 4, the means mounting the stack comprising a lever having a first and a second end, means mounting the lever at its first end for swinging movement, the stack of spring plates being secured at the second ends thereof to the first end of the swingable lever, a cam follower mounted at the second end of the swingable lever, and cam means engaging the cam follower for swinging the swingable lever and causing the stack of spring plates at the second ends thereof to be turned between the first and second angular positions.

6. In an apparatus as defined in claim 4, the collecting means including means for reducing the holding force exerted by the spring plates upon the accumulated stack of strip sections to facilitate removal of the accumulated strip sections from the collecting means as a stack, the means for reducing the holding force comprising means for turning the stack of spring plates at the second ends thereof from the second angular position in the first direction through a limited turning angle to an intermediate third angular position.

7. In an apparatus as defined in claim 6, the means operative for stressing the stack comprising a drive motor, first, second and third rotary cams driven by the drive motor, a cam follower mounted to track the first rotary cam and coupled to the stack of spring plates at the second ends thereof, the configuration of the first rotary cam being such that when driven by the drive motor the cam follower turns the stack of spring plates at the second ends thereof to the first angular position, then the second angular position and then the third angular position, a first microswitch operative for sensing the presence or absence of strip sections at the collecting means, a second microswitch responsive to the angular position of the second rotary cam, a third microswitch responsive to the angular position of the third rotary cam, the second cam being configured to cause the second microswitch to produce a spring-plates-stressed signal when the stack of spring plates at the second ends thereof are in the second angular position, the third cam being configured to cause the third microswitch to produce a spring-plates-relieved signal when the stack of spring plates at the second ends thereof are in the third angular position, and control means operative for controlling the operation of the drive motor in dependence upon the signals produced by the first, second and third microswitches.

8. In an apparatus as defined in claim 7, the means for repeatedly releasing the locking means comprising means operative during receipt of a spring-plates-stressed signal for releasing the locking means in response to each activation of the cutting means but after the elapse of a time delay following activation of the cutting means, the control means comprising means operative in response to an end-of-order signal for causing the drive motor to effect turning of the second ends of the spring plates to the third position and operative in response to a strips-removed signal furnished by the first microswitch for causing the drive motor to effect turning of the second ends of the spring plates to the first position and generating an enablement signal for the cutting means.

9. In an apparatus as defined in claim 4, the releasable locking means comprising a latching mechanism located in the path of turning movement of the stack of spring plates at a distance from the second ends thereof, the latching mechanism including a retractably mounted latching structure configured for retraction by the stack of spring plates when the stack of spring plates is turned in the first direction to the first angular position and configured to thereafter prevent turning of the stack of spring plates in the second direction.

10. In an apparatus as defined in claim 9, the retractably mounted latching structure being wedge-shaped.

11. In an apparatus as defined in claim 4, the spring plates of the stack of spring plates being provided with differently offset cut-outs, the releasable locking means comprising means moving the latching structure in the direction of offset of the cut-outs into register with the cut-outs of successive individual ones of the spring plates in synchronism with the arrival of strip sections at the collecting means.

12. In an apparatus as defined in claim 11, the means for moving the latching structure in the direction of offset of the cut-outs of the spring plates comprising a pair of electromagnets coupled to the latching structure, each operative for moving the latching structure in a respective direction, and means for effecting reciprocation of the latching structure by energizing the electromagnets alternately in synchronism with the arrival of strip sections at the collecting means.

13. In an apparatus as defined in claim 1, the holding means being located just downstream of the cutting means.

14. In an apparatus as defined in claim 1, the collecting means including a work table upon which the successively received strip sections are deposited, the holding plates being successively laid upon the strip sections successively deposited on the work table, the holding plates and the work table being configured to expose a portion of an accumulated stack of severed strip sections for manual engagement and removal from the collecting means.

15. In an apparatus as defined in claim 1, further including means for automatically removing an accumulated stack of severed strip sections from the collecting means as a stack.

16. In an apparatus for processing a long photographic strip, in combination, means for transporting the long photographic strip along a predetermined path; cutting means located along the path and operative for severing the successive leading end sections of the strip from the remainder of the strip to successively form severed strip sections; and collecting means operative for receiving the successively formed severed strip sections in succession and forming an accumulating stack of such sections, including holding means operative for holding the successively received strip sections in position in the accumulating stack individually, the holding means comprising a succession of individually activatable holding units, each holding unit being operative when activated for exerting a holding force upon a respective received strip section, means for activating successive ones of the succession of holding units in synchronism with the receipt of successive severed strip sections by the collecting means, and means operative when activated for simultaneously reducing the holding force exerted by the activated holding units upon the respective strip sections of the accumulated stack of strip sections to facilitate simultaneous removal of the accumulated strip sections from the collecting means in the form of a single stack.

17. In an apparatus for processing a long photographic strip, in combination, means for transporting the long photographic strip along a predetermined path; cutting means located along the path and operative for severing the successive leading end sections of the strip from the remainder of the strip to successively form severed strip sections; and collecting means operative for receiving the successively formed severed strip sections in succession and forming an accumulating stack of such sections, including holding means operative for holding the successively received strip sections in position in the accumulating stack individually, the holding means comprising a succession of individually activatable holding plates, and means for activating successive ones of the succession of holding plates in synchronism with the receipt of successive severed strip sections by the collecting means.

* * * * *